US005339146A

United States Patent [19]

Aslam et al.

[11] Patent Number: 5,339,146

[45] Date of Patent: Aug. 16, 1994

[54] METHOD AND APPARATUS FOR PROVIDING A TONER IMAGE HAVING AN OVERCOAT

[75] Inventors: Muhammad Aslam; Alec N. Mutz, both of Rochester; Dinesh Tyagi, Fairport; Kevin M. Johnson, Rochester, all of N.Y.

[73] Assignee: Eastman Kodak Company, Rochester, N.Y.

[21] Appl. No.: 41,091

[22] Filed: Apr. 1, 1993

[51] Int. Cl.[5] ..... G03G 15/20

[52] U.S. Cl. ..... 355/285; 355/282; 355/289; 355/290; 355/295; 430/47; 430/98; 430/99; 430/124; 156/277

[58] Field of Search ..... 355/285, 289, 290, 295, 355/282; 430/47, 98, 99, 124, 126; 219/216; 156/277

[56] References Cited

U.S. PATENT DOCUMENTS

| | | | |
|---|---|---|---|
| Re. 25,316 | 1/1963 | Stenger et al. | D58/5 |
| Re. 31,702 | 10/1984 | Brown | 220/269 |
| 2,618,552 | 11/1952 | Wise | 95/1.9 |
| 2,638,416 | 5/1953 | Walkup et al. | 95/1.9 |
| 2,659,670 | 11/1953 | Copley | 95/1.9 |
| 2,788,288 | 4/1957 | Rheinfrank et al. | 117/17.5 |
| 2,917,460 | 12/1959 | Solar | 252/62.3 |
| 3,694,359 | 9/1972 | Merrill et al. | 252/62.1 |
| 3,709,253 | 2/1963 | Greig | 96/1 |
| 3,809,554 | 5/1974 | Merrill et al. | 96/1 SD |
| 4,464,453 | 8/1984 | Cooper et al. | 430/126 |
| 4,772,532 | 9/1988 | Adair et al. | 430/138 |
| 4,820,618 | 4/1989 | Lawson et al. | 430/45 |
| 4,828,950 | 5/1989 | Crandall | 430/45 |
| 4,833,060 | 5/1989 | Nair et al. | 430/137 |
| 4,835,084 | 5/1989 | Nair et al. | 430/137 |
| 4,859,561 | 8/1989 | Metz et al. | 430/138 |
| 4,927,727 | 5/1990 | Rimai et al. | 430/99 |
| 4,965,131 | 10/1990 | Nair et al. | 428/407 |
| 4,968,578 | 11/1990 | Light et al. | 430/126 |
| 5,021,835 | 6/1991 | Johnson | 355/271 |
| 5,089,363 | 2/1992 | Rimai et al. | 430/45 |
| 5,089,547 | 2/1992 | McCabe et al. | 524/262 |
| 5,119,142 | 6/1992 | Swapceinski et al. | 355/285 |
| 5,157,447 | 10/1992 | Farnand et al. | 355/290 |
| 5,162,854 | 11/1992 | Hilbert et al. | 355/245 |
| 5,260,753 | 11/1993 | Hameda et al. | 355/282 |

FOREIGN PATENT DOCUMENTS

| | | | |
|---|---|---|---|
| 91586/82 | 12/1982 | Australia | G03G 13/22 |
| 63-300254 | 7/1988 | Japan | G03G 15/01 |
| 2150885 | 11/1984 | United Kingdom | G03G 15/20 |

OTHER PUBLICATIONS

Xerox Disclosure Journal, vol. 16, No. 1, Jan./Feb. 1991, p. 69.

*Primary Examiner*—Matthew S. Smith
*Attorney, Agent, or Firm*—Leonard W. Treash

[57] ABSTRACT

To create an overcoat on a toner image, a clear heat softenable particulate material is applied to a fusing surface before the fusing surface contacts the toner image in a fusing nip. The particulate material softens in the fusing process and ends up as a clear overcoat for the toner image, protecting it from scratches, fingerprints, deglossing and/or softening from heat.

10 Claims, 4 Drawing Sheets

METHOD AND APPARATUS FOR PROVIDING A TONER IMAGE HAVING AN OVERCOAT

This invention relates to the formation of toner images on a receiving sheet, which toner images contain an overcoat. Although not limited thereto, this invention is particularly useful in providing multicolor images on a receiving sheet having a heat softenable layer, which heat softenable layer is useful in transfer and fixing the images.

U.S. Pat. Nos. 4,968,578, Light et al, issued Nov. 6, 1990 4,927,727, Rimai et al, issued May 22, 1990; and 5,021,835, Johnson, issued Jun. 4, 1991, all describe a heat-assisted toner image transfer method particularly usable with small particles. Two or more single color images are transferred in registration from an image member to a receiving sheet by heating the receiving sheet to an elevated temperature. The temperature of the receiving sheet is sufficiently high that the toner sticks to the receiving sheet and to itself. In a preferred form of the heat-assisted transfer described in these references, a receiving sheet having a heat softenable outer layer is used. The receiving sheet is heated to a temperature which softens the outer layer and the first layer or layers of the toner images partially embed themselves in the heat softened layer to assist in transfer of the first image or so. Further layers of toner from subsequent images, or dense portions of the first image, attach themselves to toner particles that are partially embedded.

U.S. Pat. No. 5,089,363 to Rimai et al, Feb.18, 1992 describes a method and apparatus for fixing such toner images to a receiving sheet having a heat softenable outer layer in which the receiving sheet is fed into a nip between two pressure members with a hard smooth ferrotyping belt contacting the image and the heat softenable layer. The pressure forces some of the toner further into the thermoplastic layer and the smooth ferrotyping belt provides a glossy finish to the print. This process is effective in removing most of a relief image caused by layers of toner which pile in heights according to the density of the image.

United Kingdom Patent Application 2 150 885, published Jul. 10, 1985, suggests laminating toner images on a paper receiving sheet using the fuser of a copier. A transparent sheet is overlaid the toner image as the receiving sheet is fed into the fuser. The transparent film is a polyester having an acrylic resin which contacts the toner image. The resin has a melting point similar to that of the toner. This laminating process for protecting toner images on paper requires a separate supply mechanism for laminating material and can be subject to delamination.

U.S. Pat. No. 4,828,950 to Crandall, issued May 9, 1989 and 16 Xerox Disclosure Journal No. 1, Januray—February 1991, p. 69, show an approach to increasing the gloss or evening the gloss on an image by applying an additional image of clear toner to the first image. The clear toner can be applied reverse imagewise or as an even layer. Australian Patent Application AU-B-91586/82 suggests applying a protective overcoat to a toner image by imagewise registration of a protective toner image.

Japanese Kokai 300254/88, laid open Jul. 12, 1988, suggests the application of a clear toner directly to an image after the image has been transferred to a receiving sheet but before fusing, which clear toner increases the gloss of certain portions of the image.

Various materials have been added to toner images for a variety of reasons. U.S. Pat. No. 4,820,618 to Lawson et al is typical of a number of references which suggest applying a solvent to a toner image to increase its transparency in making proofs. U.S. Pat. No. 3,079,253 to Greig suggests adding a material to a toner image prior to fusing for submerging zinc oxide particles and increasing gloss. See also U.S. Pat. No. 4,772,532 to Adair et al and U.S. Pat. No. 4,859,561 to Metz et al.

A problem with electrophotographic images, especially electrophotographic images using the process described in the Light and Rimai et al patents in which a heat softenable layer is used for transfer and to increase gloss is that the images do not necessarily wear as well as desired. The toner binder has a low molecular weight, making the toner brittle at normal temperatures and easily scratched. The heat softenable layer and the toner have relatively low glass transition temperatures in order to work in the process, especially the transfer portion of the process. This means that fingerprints become difficult to avoid and they are subject to softening in warm environments.

SUMMARY OF THE INVENTION

It is an object of the invention to provide a method and apparatus for improving the characteristics of a toner image.

These and other objects are accomplished by an image forming apparatus which includes means for forming a toner image on a receiving sheet and a fixing device. The fixing device includes a fusing member having a movable fusing surface for contacting the toner image on the receiving sheet, means for heating the toner image, and means for applying a clear heat softenable particulate material to the fusing surface before the fusing surface contacts the toner image to form a clear overcoat on the toner image.

The object is also accomplished by a method including contacting the toner image with a moving fusing surface heated to a temperature sufficient to fix the image and applying a clear heat softenable particulate material to the fusing surface before the fusing surface contacts the toner image to form a clear overcoat on the toner image.

According to a preferred embodiment, the clear particulate material can include materials which increase the resistance to scratching, the resistance to deglossing, and the resistance to softening in heated environments, which materials may be difficult to originally incorporate in the toner because of the use of a heat assisted transfer process. Thus, although the invention is not limited thereto, it has particular utility in a process in which heat is used to transfer toner to a receiving sheet. It is especially useful, in color image forming methods and apparatus in which heat is used to transfer color toner images to a receiving sheet having a heat softenable layer for receiving the image.

DESCRIPTION OF THE PREFERRED EMBODIMENTS

Figure 1:
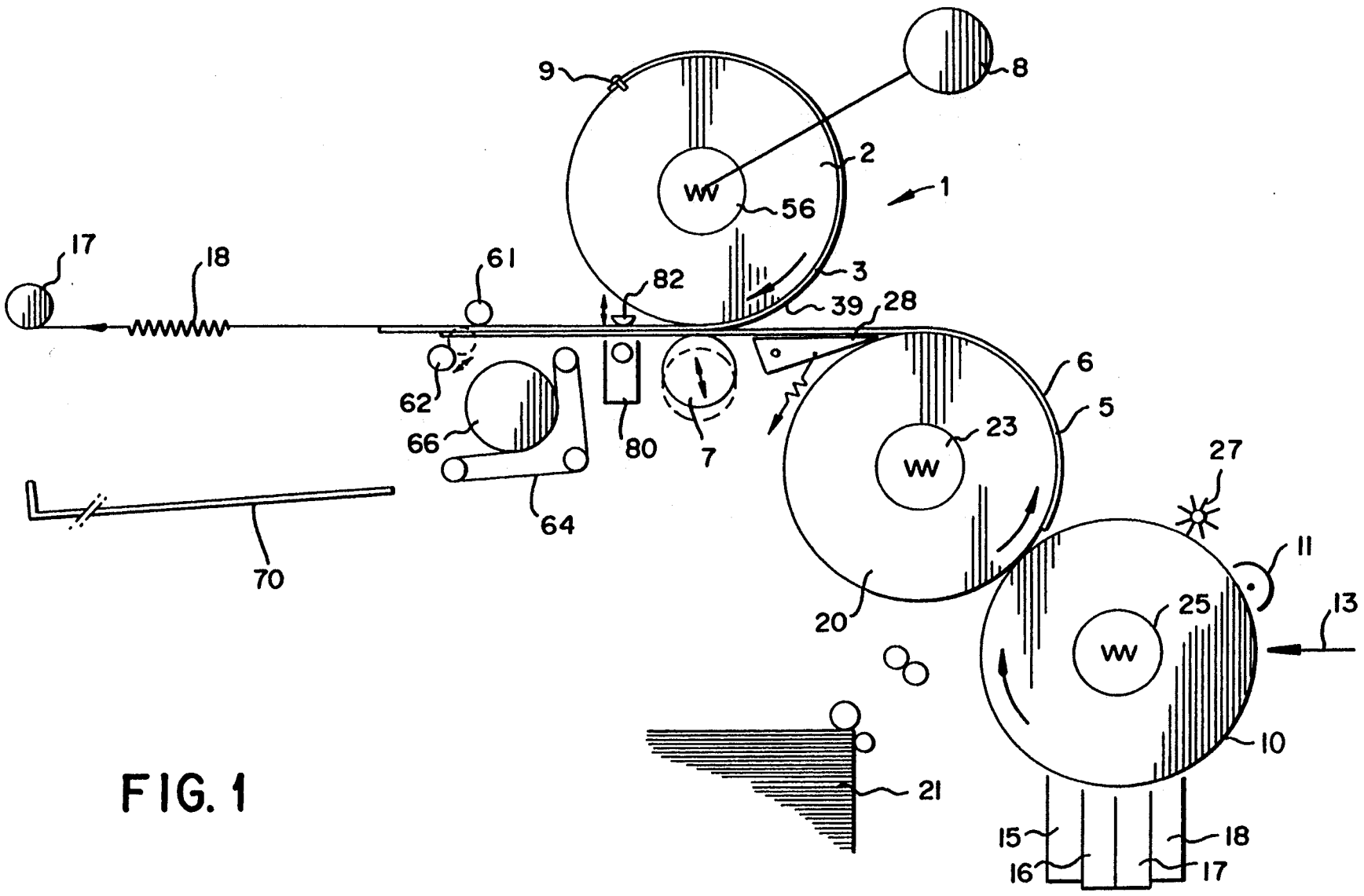
FIGS. 1 and 2 are side schematics of an image forming apparatus illustrating its operation.
Figure 2:
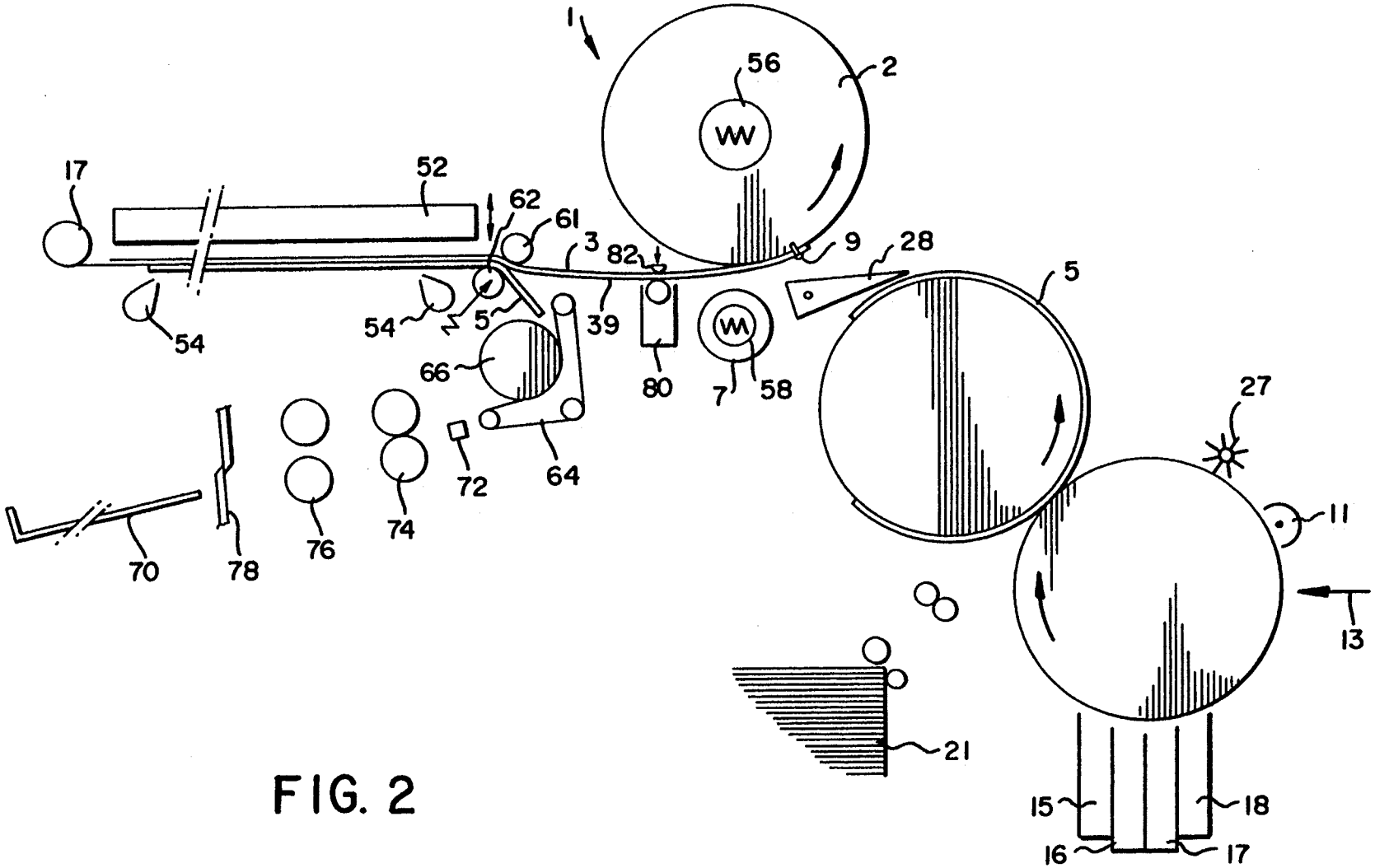

The image forming apparatus shown in FIGS. 1 and 2 includes a fuser 1 utilizing a fusing sheet 3. The image forming apparatus shown in FIGS. 3 and 4 has a fuser 30 which utilizes a fusing belt 31. Both fusers 1 and 30 cooperate with a clear toner applying station 80, but their structures are otherwise quite different. Further, both image forming apparatus are particularly designed to work with a receiving sheet 5 having a heat softenable layer which helps form a high quality image. The heat softenable layer is described in references cited above and assists in a heat transfer process which will be described in somewhat more detail and helps provide a uniformly glossy final image.

This receiving sheet with a heat softenable layer is particularly useful in making high quality color images with high gloss. However, both image forming apparatus shown in FIGS. 1 and 2 and in FIGS. 3 and 4 can also be used with single color images and they can be used on other receiving sheets such as plain paper or conventional transparency stock.

According to FIGS. 1 and 2, an image forming apparatus includes an image member, for example, a photoconductive drum 10 which is rotated to bring its outside surface through a series of stations, known in the art. The outside surface is first uniformly charged by a charger 11 and then imagewise exposed by an exposure station, for example, a laser 13 to create a series of electrostatic images. The electrostatic images are toned by the application of different color toners from a series of toning stations 15, 16, 17 and 18. Each toning station contains a different color toner and is used to tone one of the series of electrostatic images to create a series of different color toner images on image member 10.

The different color toner images are transferred in registration to an image receiving surface 6 of a receiving sheet 5 fed from a supply 21 of receiving sheets to the periphery of a transfer drum 20. The receiving sheet 5 is held to the periphery of transfer drum 20 by suitable means, for example, a vacuum, electrostatics or gripping fingers, all well known in the art.

Transfer of the toner images from image member 10 to image receiving surface 6 can be accomplished electrostatically. However, for highest quality color images, it is preferred that transfer drum 20 is heated, for example, by a heating lamp 23 to a temperature sufficient to assist in the transfer of toner from image member 10. More specifically, drum 20 is heated until receiving sheet 5 reaches a temperature which causes sintering of the toner where it touches image receiving surface 6 and also causes sintering of the toner where it touches other toner particles carried by image member 10. This sintering of the toner causes the toner particles to stick to the receiving sheet and to each other. If the image receiving surface 6 is defined by a heat softenable layer on receiving sheet 5, that heat softenable layer is softened by the heated transfer drum 20, which softening assists in the transfer of the images, especially the first image being transferred.

Image member 10 can also be heated, for example, by a lamp 25. It should only be heated to a temperature safe for its photoconductive layers, for example, 30°–40° C. To provide some width of nip for more thorough and uniform heating of the toner, a compliant backing for the photoconductive layer on image member 10 can provide that compliance without affecting heating of the receiving sheet. For good dimensionaal stability, a cloth backed compliant blanket used in the printing industry can be attached to a metallic drum and a photoconductive web or sheet attached to its outside surface to form image member 10.

The images are transferred in registration to the receiving sheet to create a multicolor toner image. As the last image is being transferred, a paper separating skive 28 is moved into contact with transfer drum 20 to separate receiving sheet 5 from drum 20. Receiving sheet 5 is moved by rotation of drum 20 into a nip formed by a pair of pressure members, a fusing sheet drum 2 and a fusing roller 7. A fusing sheet 3 has first and second ends. The second end is attached by a suitable attaching means 9 to the periphery of fusing sheet drum 2. Its first end is attached to a spring 18 which, in turn, is attached to a spring roller 17 gently urging fusing sheet 3 in a first direction (from right to left in FIGS. 1 and 2).

Fusing sheet 3 has a fusing surface 39 which is preferably hard and smooth. For example, it can be defined by electroformed nickel, stainless steel or other metals, metals coated with a silicone release agent or certain hard plastics such as polyethylene or polypropylene. In general, a metal belt is preferred with or without a release coating because of its hardness, smoothness and thermal conductivity. As shown in FIG. 1, fusing sheet drum 2 is rotated by a reversible motor 8 in a first, clockwise direction to cause fusing surface 39 to overlay the multicolor toner image carried by image receiving surface 6. The receiving sheet 5, fusing sheet 3 and the toner image form a sandwich which passes through the nip formed by drum 2 and roller 7 and moves in the first direction toward spring roller 17. One or both of drum 2 and roller 7 are heated to maintain the temperature of the toner image and any thermoplastic layer on receiving sheet 6 at or above their glass transition temperatures. The combination of heat and pressure in the nip fixes the toner image to the receiving sheet. It can also improve the gloss of the image and image receiving surface 6.

Note that the heating lamps 56 and 58 (FIG. 2) which heat the pressure members are helped substantially by the heating lamp 23 associated with transfer drum 20. Thus, it is possible that either or both of lamps 56 and 58 can be eliminated if there is little heat loss is between the receiving sheet 6 leaving transfer drum 20 and the pressure nip. However, lamp 23 is generally closely controlled to prevent blistering of receiving sheet 6. Thus, it is usually desirable to add some heat in the pressure nip. Further, with some materials it is desirable to fix the image at a higher temperature than it is transferred. Thus, it is preferable to have some heat associated with the pressure nip in addition to that supplied by transfer heating lamp 23.

As the fusing sheet-receiving sheet sandwich moves in the first direction, the receiving sheet ultimately exits the pressure nip. At this point, rotation of fusing sheet drum 2 continues until the receiving sheet 5 passes a pair of separation rollers 61 and 62, at which point, drum 2 can be stopped and the receiving sheet 5 cooled. As shown in FIG. 2, cooling can be assisted by a variety of devices, for example, air cooling devices 54 and/or a heat sink 52. The heat sink 52 is moved into contact with the backside of fusing sheet 3 or receiving sheet 5 for a short period of time and then moved away.

When the receiving sheet is cooled sufficiently to bring the toner image and any heat softenable layer below its glass transition temperature, the fusing sheet drum 2 is rotated by motor 8 in a second, counter-clockwise direction to move the fusing sheet in a second direction, generally from left to right in FIGS. 1 and 2. A pair of separation rollers 61 and 62 are positioned on opposite sides of the sheets 3 and 5. Separation roller 62 is movable as or before the sheets move in the second direction to a position shown in FIG. 2 in which rollers 61 and 62 force the fusing sheet 3 through a sharp bend around roller 61. The beam strength of receiving sheet 5 causes receiving sheet 5 to refuse to follow fusing sheet 3 and it separates therefrom and enters a nip formed by a guide roller 66 and a guide belt 64.

Guide belt 64 and guide roller 66 are positioned to substantially reverse the movement of receiving sheet 5 and direct it back along a path from right to left, generally underneath the path that the fusing sheet takes and generally parallel to that path. This particular geometry, as shown in FIG. 2, allows further stations to be added for post-treatment of the receiving sheet while still maintaining compactness of the apparatus. For example, a reflection densitometer 72, a texturizing device 74, a backside printer 76, and a cutter 78 can all be positioned generally below the cooling portion of the fuser 1. Ultimately, the receiving sheet is deposited in a tray 70, shown after the additional stations in FIG. 2 and shown without the additional stations in FIG. 1.

Figure 3:
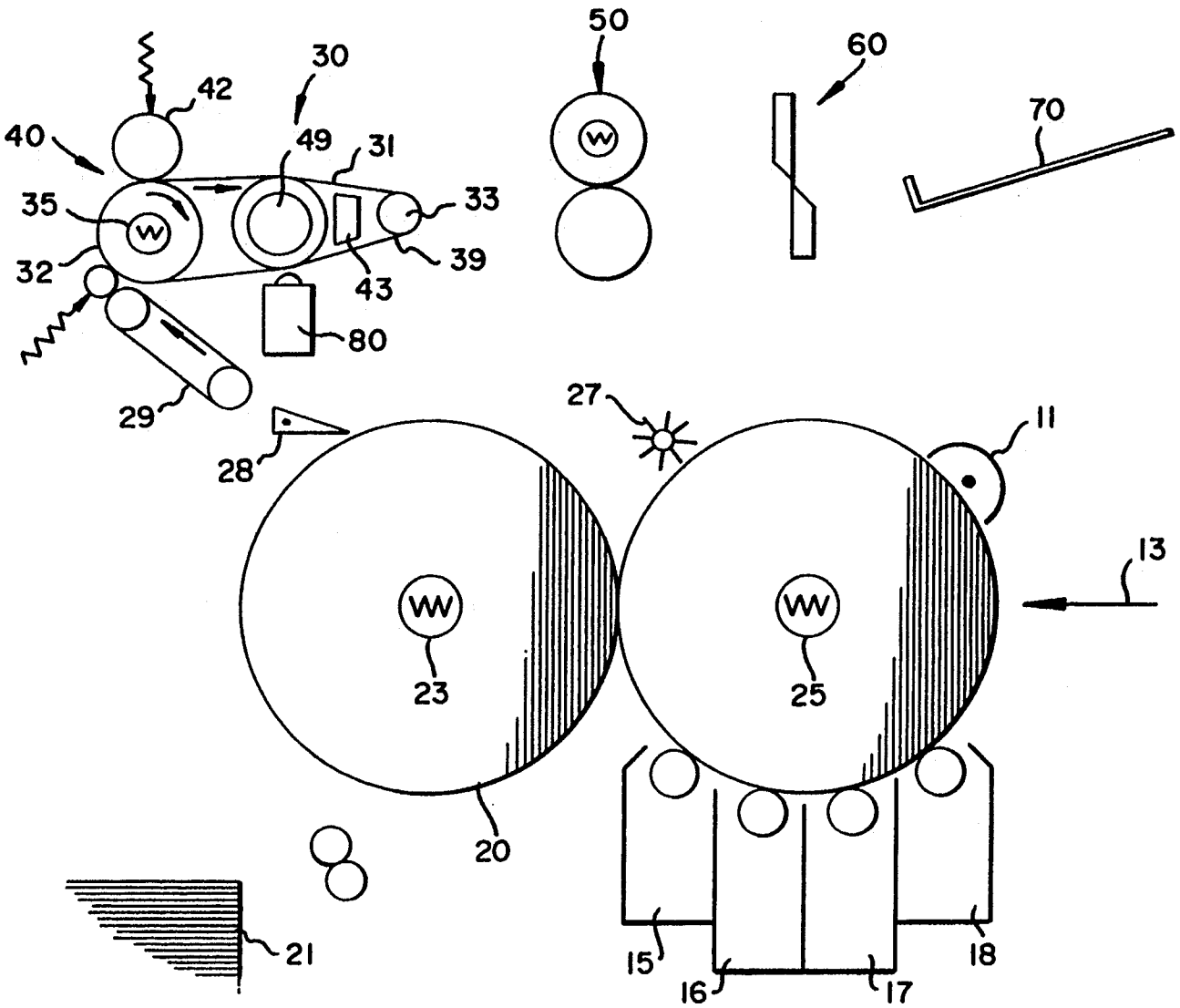
FIG. 3 is a side schematic of another image forming apparatus.
Figure 4:
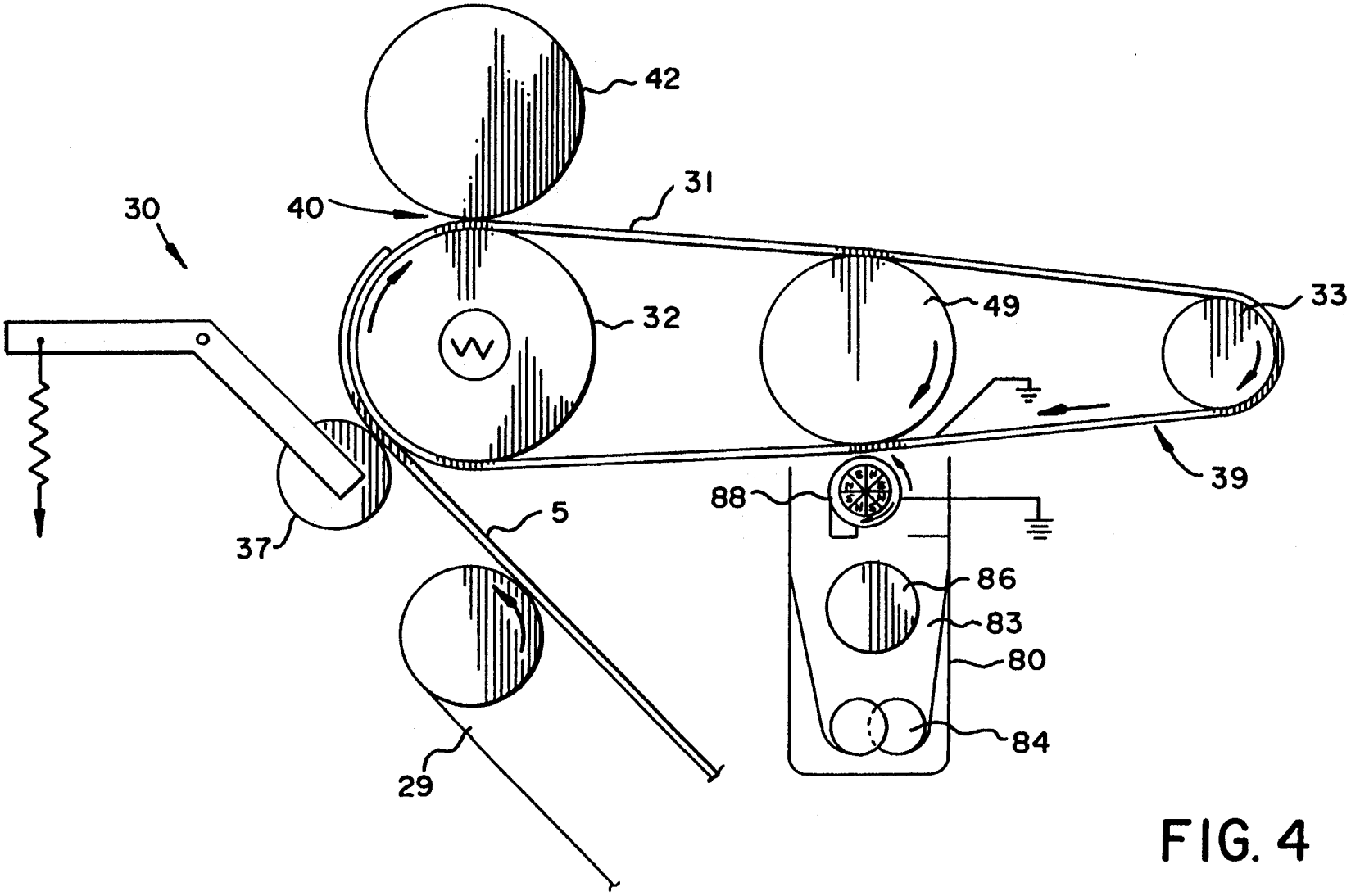
FIG. 4 is an enlarged side schematic of a portion of the image forming apparatus shown in FIG. 3.

Note that with the fuser 1, shown in FIGS. 1 and 2, the advantages of the fusing sheet are obtained with respect to providing a long cooling time while positioning the pressure nip close to the transfer station. At the same time, the necessary apparatus for recirculating the fusing sheet is eliminated, the fusing sheet always being attached to the fusing sheet drum by attaching means 9. Fuser 1 also has advantages over a belt structure (as shown in FIGS. 3 and 4), in that no belt tracking mechanism is necessary and the belt does not have to be extremely long (or move very slowly) for cooling. Further, belts are very difficult to replace, generally requiring that support rollers be cantilevered from one side of the machine. The fusing sheet shown in FIGS. 1 and 2 is easily replaced to a firmly supported fusing sheet drum 7.

FIGS. 3 and 4 show a different image forming apparatus from that shown in FIGS. 1 and 2. Multicolor images are formed on a receiving sheet 5, having a heat softenable layer, substantially as shown in FIGS. 1 and 2. However, a fuser 30 is similar to that shown in prior art U.S. Pat. Nos. 5,119,142 and 5,157,447, referred to above.

More specifically, receiving sheet 5 is transported away from transfer drum 20 by a transport mechanism 29 to fuser 30 which is shown in detail in FIG. 4. Fuser 30 includes a fusing belt 31 trained about a pair of rollers 32 and 33. Roller 32 is internally heated and roller 33 is small in diameter to assist ultimately in separation, as will be described below. Belt 31 is preferably a metal belt with a smooth hard surface and can be made of the same materials as the fusing sheet 3 described with respect to FIGS. 1 and 2. As the receiving sheet 5 approaches belt 31, it is gently pushed against belt 31 by a scuff roller 37 at a position at which the belt 31 is backed by heated roller 32. The heat from roller 32 softens the toner image and the heat softenable layer causing the receiving sheet 5 to stick to belt 31 as belt 31 proceeds around roller 32, bringing receiving sheet 5 into a nip 40 formed between roller 32, belt 31 and a pressure roller 42 which may also be heated. The image is fixed to receiving sheet 5 by the application of pressure in nip 40 while the multicolor image and thermoplastic layer are softened by the heat from roller 32.

As the receiving sheet continues on belt 31 out of nip 40, it gradually cools until it reaches small roller 33. Belt 31 is made long enough to assure that the thermoplastic layer and the toner image are both below their glass transition temperatures before reaching small roller 33. At this point, the beam strength of receiving sheet 5 separates receiving sheet 5 from belt 31 as the belt changes direction going around roller 33. Cooling of belt 31 can be aided by a heat transfer device 49 positioned between segments of belt 31 which transfers heat from the portion of the belt leaving nip 40 to the portion of the belt approaching roller 32.

Prints made using either the image forming apparatus shown in FIGS. 1 and 2 or FIGS. 3 and 4 have quite high quality and resolution and high gloss. However, such prints are vulnerable to scratches and to offset of the heat softenable layer if the prints are left in a heated environment. Toughening agents could be added to the toner and the heat softenable layer that would provide resistance to both of these effects, but such agents have an effect on the ability to create the toner images and to transfer them. They especially have a tendency to reduce the toner transfer latitude in a transfer system using heat.

This problem is solved, as best shown in FIG. 4, by applying a clear particulate material to fusing belt 31 before fusing belt 31 contacts receiving sheet 5. The clear particulate material is of a formulation that improves the scratch resistance and tendency to offset of the final image. It is melted or softened by heat from roller 32 and ultimately forms, as a clear overcoat to the image exiting nip 40.

The particulate material can be applied by any convenient mechanism that would lay down a uniform layer of toner on fusing surface 39 of belt 31. For example, the particulate material can be mixed with a magnetic carrier and applied using a conventional magnetic brush development device, as shown in FIG. 4. More specifically, particulate material applying station 80 includes a sump 83 in which the clear particulate material is mixed with the magnetic carrier by a pair of augers 84. The augers supply the mixture to a transport device 86 which transports the mixture to an applicator 88. The applicator, using a rotating magnetic core and/or a rotating shell, moves the mixture through contact with fusing surface 39 to deposit the particulate material on it. An electrical field is applied between the applicator 88 and belt 31 to assist this application. The station 80 is located at a position where the belt 31 is backed by heat exchanging device 49 to control spacing between the applicator 88 and surface 39. For more details of a station suitable for applying such clear toner, reference is made to U.S. Pat. No. 5,162,854, granted to Hilbert et al on Nov. 10, 1992, which patent is incorporated by reference herein.

Referring to FIGS. 1 and 2, a clear particulate material can also be applied to the fusing sheet in fuser 1 to later transfer to the receiving sheet to protect the image. According to FIG. 1, station 80 is positioned between pressure roller 7 and guide belt 64 and opposite the path of fusing sheet 3 from a backside support 82. Backside support 82 is movable, as shown in FIG. 2, toward station 80. When fusing sheet 3 is moving in its second direction, as shown in FIG. 2, backside support 82 is moved toward station 80 to move fusing sheet 3 downward into operative relation with station 80 for receipt of the particulate material. Pressure roller 7 is moved away from fusing sheet 3 as fusing sheet is moved in its second direction.

In both embodiments, station 80 includes a transport 86 which allows the station to be turned on and off so that clear toner is not applied to the backside of receiving sheet 5 or to a portion of surface 39 that would not overlie the image on receiving sheet 5.

In the FIG. 1 and 2 embodiment, the particulate material is substantially preheated during the time the fusing sheet is wrapped on drum 2. This reduces the heat required in the nip compared to the FIGS. 3 and 4 embodiments.

The clear particulate material can be of the same general formulation as some release toner compositions without their colorants, which are well known in the art. For example, various polymers which can be employed are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554, and fusible cross-linked polymers are described in U.S. Re. Patent No. 31,702. Other useful polymers include certain polycarbonates such as those described in U.S. Pat. No. 3,694,359, polymeric esters of acrylic and methacrylic acid, such as poly(alkyl acrylate), and poly(alkyl methacrylate), polyesters and copolyesters prepared from terephthalic acid moieties, a bis(hydroxyalkoxy)phenylalkane, and various styrene-containing polymers, such as those containing alkyl moieties and/or vinyl monomers other than styrene, such as, a higher alkyl acrylate or methacrylate. Examples of useful styrene-containing materials are disclosed in U.S. Pat. Nos. 2,917,460; Re. 25,316; 2,788,288; 2,638,416; 2,618,552 and 2,659,670. Especially preferred compositions comprise polymers of styrene or a derivative of styrene and an acrylate, preferably butylacrylate.

Clear particulate materials with release properties can include polymers with the addition of polymeric binder release additives or low surface energy, low molecular weight additives. The release additives even in a dispersed phase must match the refractive index of the clear material to maintain its transparency. These release additives may comprise fatty acids (for example, stearic acid, oleic acid, azelaic acid, and pellargonic acid), fatty alcohols, fatty acid esters (for example, polyvinyl stearate), metathenic soaps of fatty acids (for example, calcium stearate, and barium laurate), metallic complexes of fatty acids (for example, sodium stearate, and potassium oleate), organic complexes of silicon, hydrocarbon waxes, glycols and polyglycols. These and other release additives are all well known in the art. For example, see U.S. Pat. No. 4,464,453 for more information on toner release additives usable in this material. The preferred release additives for this invention are zinc stearate, olefin wax, octadecyl succinic anhydride and stearic acid and the most preferred method to prepare the clear release materials is by adding these release agents to a conventional colorless toner binder.

Alternatively, the clear release material can be made by modifying the polymer structure of a clear toner by the incorporation of comonomers which lower the surface energy of the clear toner. For details on making clear release materials with this release formulation, see U.S. Pat. No. 5,089,547, titled, "Cross-linked Low Surface Adhesion Additives For Toner Compositions". For example, the clear release material may comprise a silicone resin, a polyester cross-linked with a polyfunctional epoxy novolac resin or low surface energy comonomers such as isobutyl methacrylate, isopropyl methacrylate, heptafluoromethacrylate, and n-butyl methacrylate.

The clear release materials used in the process of this invention can be made by conventional melt compounding and grinding of a charge agent, binder, pigment and appropriate additive for release properties. Or, the clear release materials can be made by suspension polymerization. For details on the suspension polymerization process, see U.S. Pat. Nos. 4,965,131,4,835,084 and 4,833,060 .

The melt viscosity of this clear particulate material can be picked to provide the desired finish on the final print. For example, if the melt viscosity is low at the fusing temperature, a higher gloss would be obtained than with a higher melt viscosity. Matting agents could also be added to the particulate material to reduce the gloss of the final print. Note that using this system the $T_g$ of the clear material need not be compatible with that of the other toner for transfer purposes. Since the clear particulate material need not be capable of clean and easy transfer at the $T_g$ of the image forming toner, it may well assist fusing at a lower temperature and prevent deglossing and relief in the final image in addition to the traditional protections of an overcoat against fingerprints, offset and scratches.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

means for forming a toner image on a receiving sheet, a fixing device including a fusing member having a movable fusing surface for contacting the toner image on the receiving sheet, means for heating the toner image, and means for applying a clear heat softenable particulate material to the fusing surface before the fusing surface contacts the toner image to form a clear overcoat on the toner image.

2. Image forming apparatus according to claim 1 wherein said fixing device includes a pressure member for forming a fusing nip with the fusing member for applying pressure to the toner image and the particulate material.

3. Image forming apparatus according to claim 2 wherein the means for heating includes means for heating the fusing member to a temperature sufficient to raise or maintain the temperature of both the toner image and the particulate material at least to or at their glass transition temperatures.

4. Image forming apparatus comprising:

means for forming a toner image on a receiving sheet, first and second rotatable pressure members positioned to form a fusing nip, means for heating at least one of said pressure members, means defining a fusing surface movable through said nip with said rotatable pressure members for contacting the toner image on the receiving sheet, means for feeding the receiving sheet into the fusing nip with the toner image contacting the fusing surface, and means for applying a clear heat softenable particulate material to the fusing surface before the fusing surface contacts the toner image to form a clear overcoat on the toner image.

5. Image forming apparatus according to claim 4 wherein said means for applying includes means for holding a mixture of particulate material, which mixture includes a magnetic particulate carrier and said clear heat softenable particulate material, means for moving said mixture through close proximity or contact with the fusing surface and means for applying an electric field between said mixture and said fusing surface to urge the deposit of clear heat softenable particulate material from said mixture on said fusing surface.

6. Image forming apparatus according to claim 4 including an endless belt supported for movement around one of said pressure members and defining said fusing surface.

7. Image forming apparatus according to claim 4 wherein said fusing surface defining means is a fusing sheet movable between said pressure members while contacting the toner image.

8. Image forming apparatus according to claim 7 wherein said fusing sheet is movable in a first direction through said nip with the receiving sheet and in a second direction to return to a position to receive another receiving sheet and said means for applying is positioned to apply the particulate material to the fusing surface when said fusing sheet is moving in the second direction.

9. A method of forming a color print on a receiving sheet, said method comprising:

forming a series of different color toner images on an image member, transferring said toner images in registration to a thermoplastic heat softenable layer of a receiving sheet to form a multicolor toner image, said transferring step including heating said receiving sheet to a temperature sufficient to soften the thermoplastic heat softenable layer and sinter the toner to cause the toner to stick to the thermoplastic heat softenable layer and to toner already transferred to the thermoplastic heat softenable layer, fixing said multicolor toner image to the thermoplastic heat softenable layer by heating said receiving sheet containing said multicolor image while moving the receiving sheet through a fusing nip formed between two pressure members with the toner image in contact with a fusing surface associated with one of said pressure members, and applying a clear heat softenable particulate material to the fusing surface before the fusing surface contacts the toner image to form a clear overcoat on the toner image.

10. A method of forming a protective overcoat on a toner image carried by a receiving sheet, said method comprising contacting the toner image with a moving fusing surface heated to a temperature sufficient to fix the image and applying a clear heat softenable particulate material to the fusing surface before the fusing surface contacts the toner image to form a clear overcoat on the toner image.

* * * * *